United States Patent [19]

Dettmer

[11] Patent Number: 4,484,189

[45] Date of Patent: Nov. 20, 1984

[54] MEMORYLESS ARTIFICIAL HORIZON GENERATOR

[75] Inventor: Jay R. Dettmer, Columbia, Md.

[73] Assignee: Sperry Corporation, New York, N.Y.

[21] Appl. No.: 389,808

[22] Filed: Jun. 18, 1982

[51] Int. Cl.[3] ..... G09G 1/16

[52] U.S. Cl. ..... 340/723; 340/724; 340/747; 340/974

[58] Field of Search ..... 340/721, 723, 724, 734, 340/747, 474, 975, 980; 434/43, 38

[56] References Cited

U.S. PATENT DOCUMENTS

| | | | |
|---|---|---|---|
| 3,521,228 | 7/1970 | Congleton et al. | 340/724 |
| 3,668,622 | 6/1972 | Gannett et al. | 340/724 |
| 3,882,446 | 5/1975 | Brittian | 340/723 |
| 4,149,148 | 4/1979 | Miller et al. | 340/724 |
| 4,189,743 | 2/1980 | Schure et al. | 340/747 |
| 4,371,872 | 2/1983 | Rossman | 340/721 |

*Primary Examiner*—Gerald L. Brigance

*Attorney, Agent, or Firm*—Howard P. Terry; Seymour Levine

[57] ABSTRACT

An artificial horizon display generator determines either sky shading or ground shading in real time as each pixel of a raster display is generated. Transition line parameters are specified by host processor, whereupon the display generator computes whether the raster line currently being generated will intersect the horizon boundary line, and if so, at what X-Y transition point. Pixels generated prior to the transition point are of the initial shading; pixels generated subsequent to the transition point are of the opposite shading.

12 Claims, 4 Drawing Figures

MEMORYLESS ARTIFICIAL HORIZON GENERATOR

BACKGROUND OF THE INVENTION

1. Field of the Invention

This invention relates, in general, to aircraft flight instrumentation and, more particularly, to an artificial horizon raster generator in which a two color display is specified entirely by the horizon line or transition line parameters. More specifically, the invention relates to a dedicated artificial horizon raster generator which requires no memory and removes the horizon line computation burden from the on board host processor.

2. Description of the Prior Art

Two basic methods have been used by prior art artificial horizon raster systems. The most basic method is to represent every screen pixel with a memory element. While this bit per pixel method is very flexible, the large amount of memory required is costly and requires extensive host processor computations. A typical two color display consisting of 256 lines with 256 pixels per line requires 65,536 memory elements.

By making use of the artificial horizon display's simplicity, a second prior art method uses character blocking to reduce memory requirements. The two color display is divided into many blocks, each consisting of many screen pixels. Each block is then assigned a character to define the colors of the individual pixels. Typically, 90% of the display can be produced using only two characters, one character representing sky shading and the other character representing ground shading. The remaining 10% of the display, which comprises the transition region or horizon boundary line between sky shading and ground shading, may be defined using a few more characters. A typical two color horizon display consisting of 256 lines with 256 pixels per line, divided into four by four pixel blocks, can be defined with 128 different characters assigned to the 4,096 blocks. Such an implementation requires 30,720 memory elements. While this character blocking method reduces the amount of memory required, the host processor's computation burden is still extensive and the amount of memory used remains considerable.

A technique for further reducing the host processor's computation burden is discussed in U.S. Pat. No. 4,149,148 entitled "Aircraft Flight Instrument Display System", invented by Miller et al. and assigned to the assignee of the present invention. As taught by Miller, the horizon display may be reduced to a straight line which separates the two color areas. The entire display may then be specified simply by specifying the transition line parameters, that is, the slope of the horizon line, the starting color, and the horizontal and vertical coordinates of the point at which the raster scan will first encounter or intersect the horizon boundary line. The entire display is then generated by computing each transition point intersected by each raster scan line and storing these points in memory. Also stored in memory is the video shading information representative of the appropriate sky or ground shading corresponding to each raster line. Thus the sky-ground shading is provided by addressing memory in synchronism with the raster scan, and changing the shading from sky to ground or vice versa in accordance with the information stored in the memory. It is noted that this method requires the host processor to compute each transition point intersected by the raster scan line, thus placing a burden on the host processor. Second, the transition points so computed must be stored in memory for later use. These two requirements are considered undesirable since the host processor is usually responsible for controlling a plurality of flight instruments. Assigning the processor the additional task of controlling the artificial horizon raster generator necessarily results in speed retarding interrupts and an increased memory budget. These disadvantages become even greater when one considers the impact of increasing the display resolution. For example, a change from a display of 256 lines containing 256 pixels per line to a display of 512 lines containing 512 pixels per line would double the number of host processor computations and double the amount of memory needed to store the transition points.

SUMMARY OF THE INVENTION

The present invention alleviates the above mentioned problems by removing the computation burden from the host processor and by eliminating the need for memory in connection with generating the artificial horizon.

The invention is intended to operate in conjunction with a conventional display apparatus having a display face for displaying sky-ground shading thereon, including means for generating a raster in the usual fashion. The horizon boundary line between sky and ground shadings is parametrically represented by a crossover word representing the point at which the raster line first crosses the horizon boundary, and by a slope signal representing the slope of the horizon boundary line, and further by a shading signal representing the starting shading. These parameters may be provided by the host processor in a conventional fashion.

The invention comprises a first digital timing circuit for providing a signal synchronous with the raster lines and a second digital timing circuit for providing a second digital signal synchronous with the pixels of each raster line. A transition point computing circuit provides in response to the slope signal parameter, a current or present transition point signal representing the intersection of the horizon boundary line with the raster line currently being generated and an overflow status signal. Thus, the current transition point signal is provided in real time, that is, immediately before its associated raster scan line is drawn.

The invention further comprises a first comparator responsive to the current transition point signal and to the second digital timing signal for providing a left-right signal indicating whether the pixel currently being generated is to the left or to the right of the horizon boundary line. A second comparator, responsive to the first digital timing signal and to the initial crossover word, provides an above-below signal indicating whether the raster line currently being generated is above or below the horizon boundary line.

A logic circuit responsive to the left-right signal, to the above-below signal, to the overflow status signal, to the slope signal, and to the initial shading signal determines whether the currently generated pixel is of a sky or ground shading. Depending upon the initial shading signal, the raster scan line represents one of either sky or ground shadings when the raster scan line, prior to the current transition point, is being generated and the other of said shadings when the raster scan line, subsequent to the current transition point, is being generated.

DESCRIPTION OF THE PREFERRED EMBODIMENTS

Figure 2:
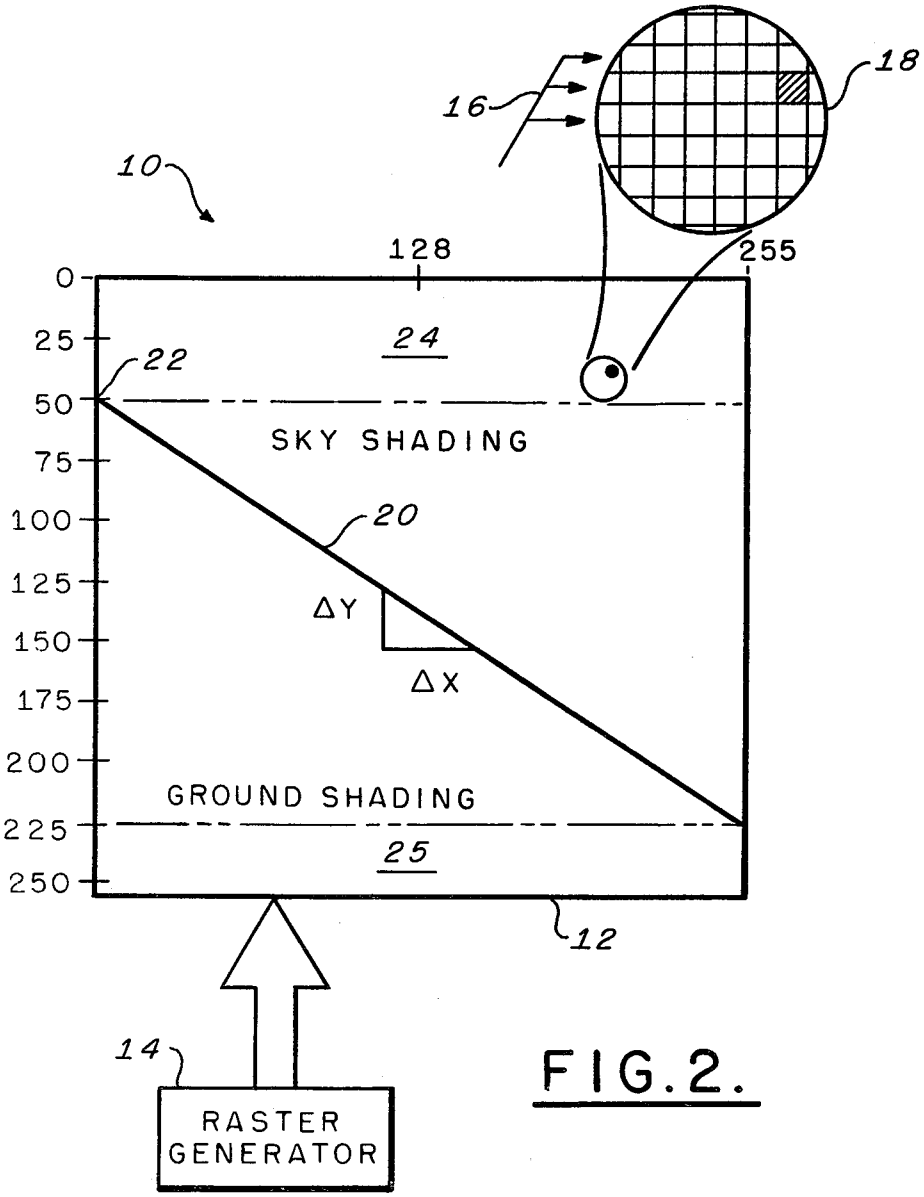
FIG. 2 is a diagram illustrating geometrical parameters utilized in generating the horizon shading.

Referring to FIG. 2, a pictorial representation of a typical horizon shading is illustrated. A display apparatus denoted generally by reference numeral 10 comprises a display face 12 for displaying thereon a sky-ground representation. The display face may be, for example, the face of a conventional CRT display, or comparable liquid crystal display, as well as other electrically actuated displays.

A conventional raster generator 14 provides, in the conventional fashion, a raster on the display face comprising raster lines 16 made up of individual pixels 18. It will be understood that these raster lines may be generated sequentially, each raster line containing a number of sequentially generated pixels. The typical display might consist of 256 raster lines, each containing 256 pixels. Greater resolution may be had by increasing the number of lines or the number of pixels per line in a given display face area.

Figure 3:
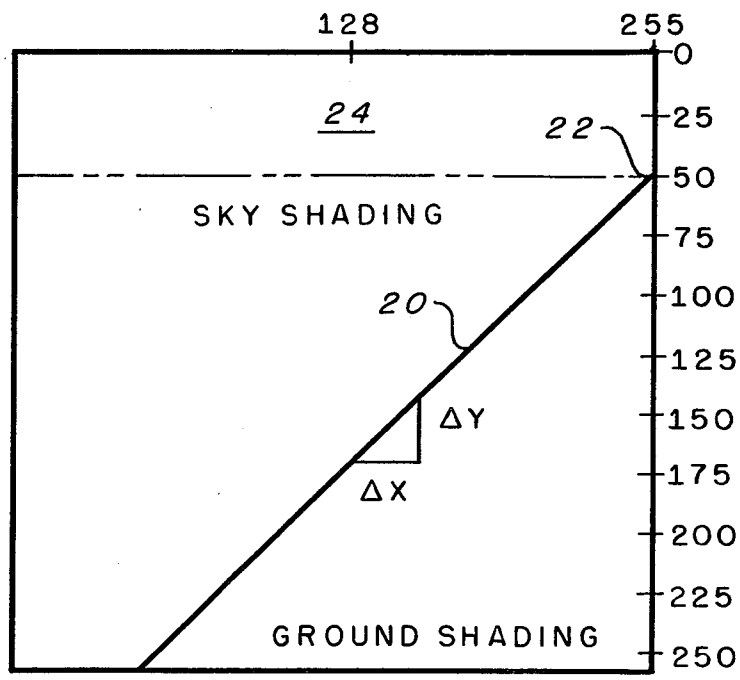
FIG. 3 is a second diagram illustrating the horizon shading.

An artificial horizon line is represented on the display face by utilizing two colors or shadings, a ground shading and a sky shading. In the presently preferred embodiment the horizon boundary line is defined as the transition line between the ground shading and the sky shading. In FIG. 2 the horizon boundary line is denoted by reference numeral 20, and is exemplary of a horizon line having a negative slope. As used herein, slope will denote the ratio of rise to run, that is, $\Delta Y/\Delta X$, in an X-Y cartesian coordinate system. FIG. 3 illustrates an exemplary horizon boundary line having a positive slope.

For purposes of describing the invention, it will be assumed that raster generator 14 generates a raster beginning at the origin O in the upper left hand corner of display face 12 and then draws a raster line horizontally by holding the Y deflection constant while ramping the X deflection signal through these successive pixels of the first line. At the end of the first line the Y deflection is incremented to the second line and the X deflection is initialized. A second raster line is then drawn horizontally by holding the Y deflection constant while ramping the X deflection signal. In this fashion, the entire raster pattern is generated. Alternatively, the raster may be generated in both directions on alternate lines. The present invention is applicable, as will be understood, regardless of the particular sequence chosen to implement the raster. Furthermore, the starting point or origin O in the upper left-hand corner is chosen for convenience, and is not to be construed as a limitation of the invention.

With continued reference to FIGS. 2 and 3, the horizon boundary line 20 has an initial crossover point 22, defined as the point at which the horizon boundary line first coincides with or intersects the raster line currently being generated. It will be seen that raster lines occurring above this initial crossover point, that is occurring earlier in time, do not intersect the horizon boundary line. Raster lines in this non-intersecting region are located in FIGS. 2 and 3 in the area denoted by the reference numeral 24. The initial crossover point 22 may be characterized in terms of a numerical word, hereinafter referred to as the initial crossover word, representing the Y axis position or coordinate (line number) and X axis position or coordinate (pixel number) of the initial crossover point. In FIG. 2, for example, the initial crossover point occurs at approximately the 51st line down from the origin and at the 0th pixel position to the right of the origin. Thus the initial crossover word would comprise an X axis coordinate of 0 and a Y axis coordinate of 51. In FIG. 3, in contrast, the initial crossover point 22 occurs approximately 51 lines down from the origin at the 255th pixel position, that is with an X axis coordinate of 255 and a Y axis coordinate of 51.

Figure 1A:
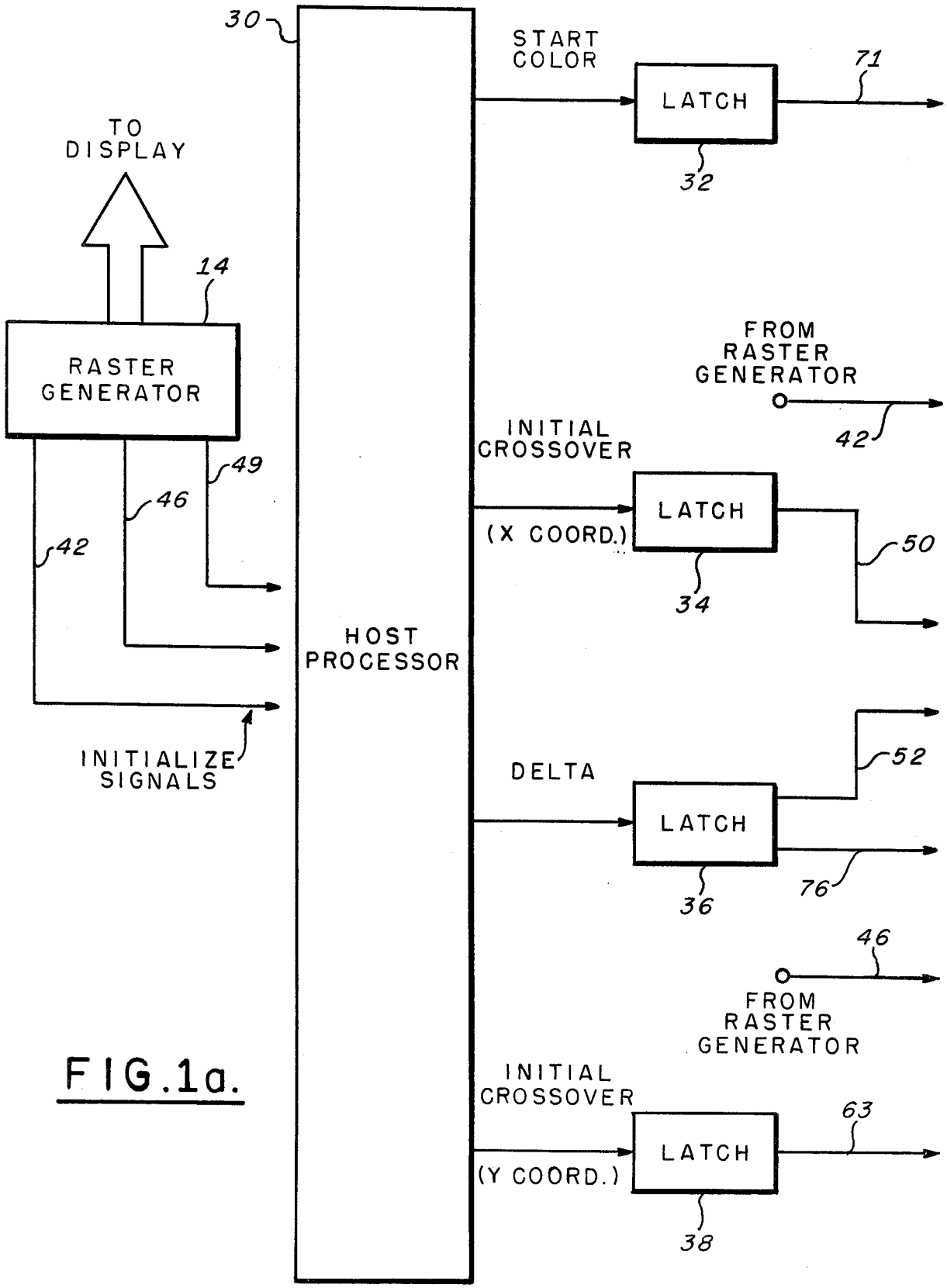
FIG. 1 is a schematic block diagram of the invention.
Figure 1B:
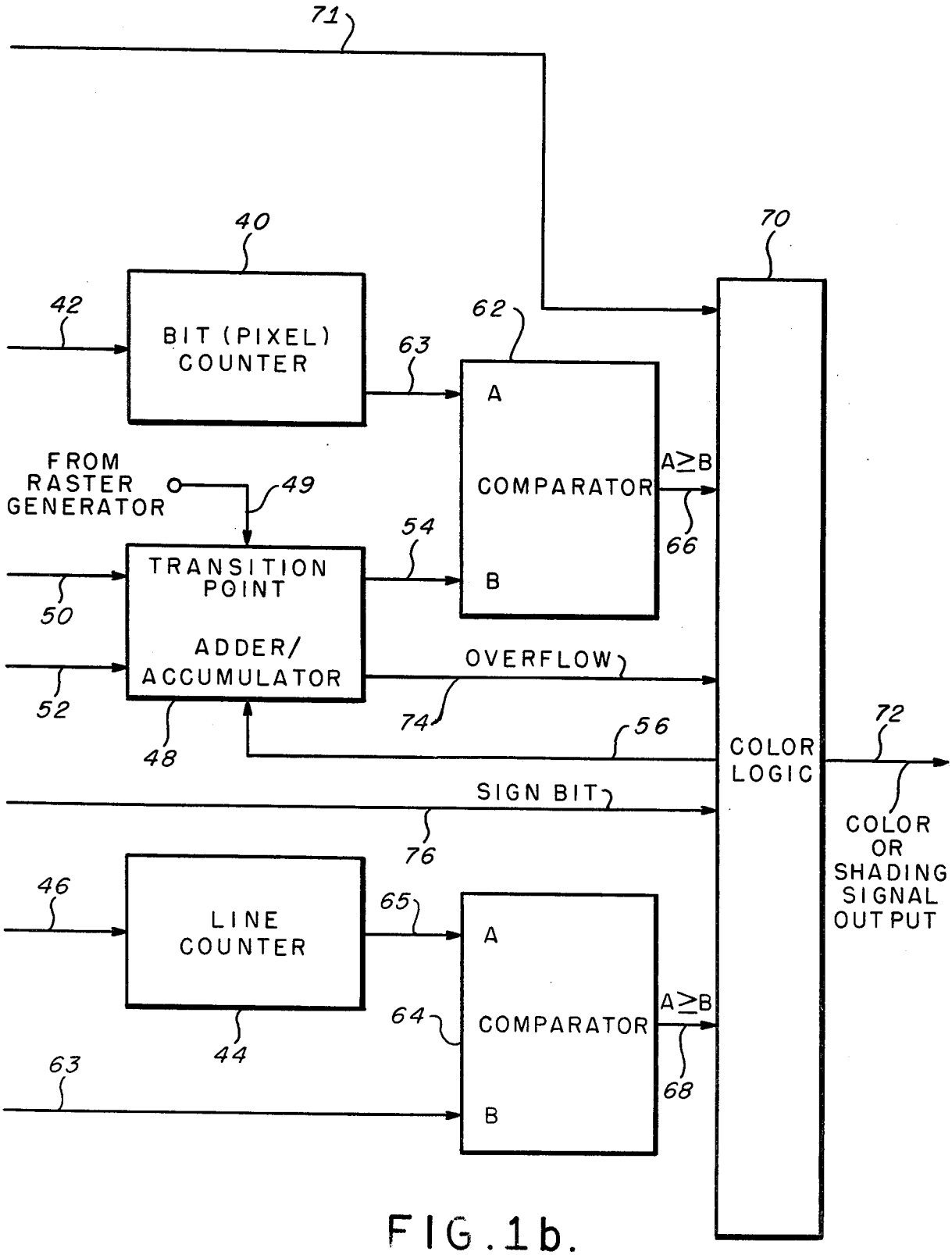

Referring now to FIG. 1, the presently preferred embodiment is illustrated in conjunction with a conventional host processor 30 and raster generator 14. The host processor generates in the conventional fashion those parameters necessary to define the horizon boundary line as taught in U.S. Pat. No. 4,149,148, the disclosure of which is incorporated herein by reference. Briefly, the host processor 30 provides the initial crossover word comprising the X and Y coordinates of the initial crossover point. The host processor also provides a slope signal determined by the magnitude and sign of the slope of the horizon boundary line. The host processor also provides an initial shading signal representing one of the sky or ground shadings. As used herein, the initial shading is used synonymously with the term start color and is taken to mean the first color or beginning color of any raster line which passes through the horizon boundary line. The terminology "hot" start color denoted as start color represents the second shading or color of any line after it has passed through the horizon boundary line. In FIG. 2, line 60 has a start color corresponding to a ground shading, whereas in FIG. 3 line 60 has a start color corresponding to a sky shading. It is noted that line 5, for example in both FIGS. 2 and 3, does not intersect with the horizon boundary line. Thus, the concept of start color is not applicable to line 5.

The invention comprises four latches 32, 34, 36, and 38 receptive of the horizon boundary line parameters and the initial shading information from host processor 30. Latch 32 receives the start color or initial shading characteristic of the first raster line to cross the horizon boundary line. For example, if the horizon boundary line is exemplified by FIG. 2, the initial shading or start color is the ground shading. If the horizon boundary line is exemplified by FIG. 3, the start color is the sky shading. Latches 34 and 36 receive the horizon boundary line slope inforamtion from host processor 30. Latch 34 receives the initial crossover word representing the X axis coordinate where the raster line first crosses the horizon boundary line. For a horizon boundary line exemplified by FIG. 2, this X axis initial crossover coordinate is seen to be zero, whereas for the horizon boundary line of FIG. 3 the X axis initial crossover coordinate is 255. Note that an X axis initial crossover coordinate of zero corresponds to a negative slope, whereas an X axis coordinate of 255 cooresponds to a positive slope. Thus, the X axis coordinate of the initial crossover point, for the conditions shown in FIGS. 2 and 3, can be used to indicate the sign of the slope.

Latch 36 receives a numerical value or delta transition factor based on the slope of the horizon boundary line as computed by the host processor, the numerical value being calculated according to the formula ($\Delta X/\Delta Y$). The sign of this computed value may be used to unambiguously determine the sign of the slope.

Latch 38 receives the Y axis coordinate of the initial crossover point. In FIGS. 2 and 3, this Y axis initial crossover coordinate is approximately 51, meaning that the first 50 lines are generated in one color without making a single transition.

The presently preferred embodiment further comprises a bit counter or pixel counter 40, initialized by raster generator 14 via lead 42 at the beginning of each raster scan, that counts in synchronism with the pixels being generated to provide the second digital timing signal. A line counter 44, initialized by the vertical sync coupled from raster generator 14 via lead 46, counts in synchronism with the raster lines being generated to provide the first digital timing signal. Thus taking the bit counter 40 and line counter 44 together, the invention generates a pixel number and line number corresponding to the pixel address currently being generated by the conventional raster generator. In terms of the XY cartesian plane, bit counter 40 generates the X position and line counter 44 the Y position.

The invention further comprises a transition point adder and accumulator 48. The adder and accumulator 48 receives the initial X axis crossover coordinate on lead 50 as well as the delta transition factor signal on lead 52. The adder and accumulator 48, initialized by the vertical sync coupled from raster generator 14 via lead 49, causes the initial X axis crossover coordinate to be stored in the accumulator. The adder accumulator 48 updates the transition point value after each raster scan and provides the current transition point value on output lead 54. An enable signal, yet to be explained, is coupled to the adder accumulator 48 from lead 56 to indicate when the current raster line is no longer in the non-intersecting region denoted by reference numeral 24 in FIGS. 2 and 3. When enabled, the adder/accumulator 48 updates the transition point for the next succeeding raster line by adding to the current transition point value stored in the accumulator the delta transition factor in latch 36. It will be seen that this factor to be added is equal to the negative reciprocal of the slope. After being computed the new transition point is stored in the accumulator and may be accessed on lead 54.

The invention employs two comparators, the first comparator 62 for testing whether the pixel currently being generated is to the right or to the left of the horizon boundary line. The second comparator 64 determines whether the current raster line being generated is above or below the initial crossover point 22. In other words, comparator 64 tests whether the current raster line is within or not within the area 24 of FIGS. 2 and 3.

More particularly, comparator 62 receives a signal indicative of the current pixel via output lead 63 from bit counter 40. Comparator 62 compares this value with the current transition point stored in adder/accumulator 48 via lead 54. If the numerical output of bit counter 40 is greater than or equal to the numerical output of adder accumulator 48, comparator 62 outputs a logical high signal on lead 66. Otherwise the output signal on lead 66 is low.

Comparator 64 receives a signal indicative of the current raster line being generated from the line counter via lead 65 and compares the numerical value of this signal with the initial Y axis crossover word stored in latch 38. If the output of line counter 44 is greater than or equal to the initial crossover word stored in latch 58, comparator 64 outputs a logical high signal on lead 68. Otherwise the signal on lead 68 is low. The signal on lead 68 is coupled to lead 56 and is utilized as the enable signal for the adder/accumulator 48.

The invention further comprises a color logic circuit 70. Color logic circuit 70 receives the start color signal stored in latch 32 via lead 71. The color logic circuit 70 also receives the output of comparators 62 and 64 via leads 66 and 68 respectively. In the presently preferred embodiment the color logic circuit provides an enable signal on lead 56, as previously discussed, for signifying when the line count stored in line counter 44 is greater than or equal to the initial Y axis crossover coordinate stored in line delay latch 58. It will be seen that this enable signal may be supplied by other means, as well. For example, the enable signal may be derived from the output of comparator 64. The color logic circuit further provides an output lead 72 on which a logical signal signifying either a sky shading or a ground shading is provided. It will be understood that this color or shading signal may be connected (not shown) to the display apparatus in order to control the shading or color of each pixel as it is generated.

The color logic circuit 70 also receives a signal, via lead 74, indicating whether the current transition point is on or off the display screen. With reference to FIG. 2, it will be seen that the transition points corresponding to raster lines in the region denoted by reference numeral 25 are off the display screen. In contrast, referring to FIG. 3, it will be seen that the transition point is always on the screen. The signal indicating whether the current transition is on or off the screen may be derived from the overflow bit within the adder/accumulator 48. In the usual fashion, this overflow bit would contain a zero unless a borrow or carry is performed by the adder. Such a borrow or carry would normally occur when the number to be stored in the accumulator is negative or exceeds the number of pixels per line, typically 256.

Color logic circuit 70 also receives a signal, via lead 76, indicating whether the slope of the horizon boundary line is positive or negative. In the preferred embodiment, this signal is indicated by the sign bit of the delta transition factor utilized by the adder/accumulator to update the current transition point value.

The operation of the color logic circuit 70 may be further understood with reference to the following table.

TABLE 1

| | Color Logic | | | | |
|---|---|---|---|---|---|
| | Lead 74 Transition off Screen? | Lead 68 Line> = Delay | Lead 76 Sign of Delta | Lead 66 Bit> = Transition | Lead 72 Color Output |
| a | No | No | Positive | Don't care | Not Start |
| b | No | Yes | Positive | No | Start |
| c | No | Yes | Positive | Yes | Not Start |
| d | Yes | Don't care | Positive | Don't care | Start |
| e | No | No | Negative | Don't care | Start |
| f | No | Yes | Negative | No | Start |
| g | No | Yes | Negative | Yes | Not Start |
| h | Yes | Don't care | Negative | Don't care | Not Start |

In Table 1, the first four columns denote the possible states on color logic circuit input leads 74, 68, 76 and 66. The fifth column gives the color output corresponding to the particular input states given. It will be recalled that the start color stored in latch 32 and supplied to the color logic circuit via lead 71 may be either the sky shading or the ground shading as determined by the host processor 30. The color output signal on lead 72 thus indicates whether the pixel currently being generated should take on the start color or the not start color.

For illustration of the operation consider the horizon display of FIG. 2, and assume that the display consists of 256 horizontal scan lines, each consisting of 256 pixels per line starting in the upper left corner. The host processor 30 might compute the initial crossover X-coordinate to be zero and the initial crossover Y-coordinate to be 51, for example. Likewise, the host processor would compute the slope of the horizon boundary line and provide its negative inverse, the delta transition factor, to latch 36. In this example, the delta transition factor might equal 1.4655. The host processor also supplies the start color, in this case, the ground shading.

After the host processor puts the above computed data into the associated latches 32, 34, 36, and 38, the horizon raster generator 14 is started. The raster generator initalizes the hardware for a new display by setting the transition point adder/accumulator 48 to the initial transition point and by initializing the line counter 44 to 1. A raster line is then drawn horizontally by holding the Y deflection constant while ramping the X deflection signal. During this time the bit counter 40 is counting, each count corresponding to a display pixel, and the color logic circuit 70 is monitoring the status of the other hardware. The entire first raster line is drawn with the color equal to not start color (sky shading), since the line count of line counter 44 is not yet greater than or equal to the initial crossover Y-coordinate stored in line delay latch 58, see Table 1, line a. At the end of the raster line, the line counter 44 is incremented to 2, the Y deflection signal is moved down one line width and the X deflection signal is initialized once again. The next fifty lines are drawn similarly, all sky shading.

When the line counter 44 is incremented to 51, the color logic circuit 70 detects that the line count is now greater than or equal to the line delay. At the beginning of the line, the count in bit counter 40 is equal to 1 and the color logic circuit determines the color to be not start color (sky shading), since the bit count is greater than or equal to the transition point, namely zero, see Table 1, line c. The same is true for the remainder of the line. At the end of the line, the line counter 44 is incremented to 52, the Y deflection signal is moved down one line width and the X deflection signal is initialized. Now that the line count of line counter 44 is greater than or equal to the line delay value in latch 58, the adder/accumulator 48 is enabled by a signal on lead 56. This causes the adder/accumulator 48 to add the delta transition factor to the X-coordinate of the initial crossover point stored in latch 34 to thereby compute the new transition point for the next line.

At the beginning of line 52, the bit counter 40 is reset to one and the new transition point in adder/accumulator 48 is 1.53846. The color logic circuit 70 sets the color to the start color since the count in bit counter 40 is not greater than or equal to the transition point. See Table 1, line b. As the bit counter increments as the line is drawn, the color logic circuit 70 detects when the count in bit counter 40 is greater than or equal to the transition point in adder/accumulator 48. When this occurs, the color logic circuit 70 selects the not start color (sky shading). See Table 1, line c. The resulting line 52 will thus contain one ground shaded pixel followed by 255 sky shaded pixels. The next 164 lines are drawn similarly. For example, line 135 is drawn with 128 ground shaded pixels followed by 128 sky shaded pixels.

When the transition point is updated at line 217 to a value greater than 256, the overflow bit on lead 74 changes from 0 to 1 and the color logic circuit 70 detects that the transition point is now off the screen. The remaining 38 lines will thus all be drawn with the color equal to the start color(ground shading). See Table 1, line d.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. In a display apparatus having display face for displaying thereon sky-ground shading and horizon boundary line between said sky and ground shadings, including means for generating sequential raster lines containing sequential pixels and including processor means for providing an initial crossover word representing the point at which said raster line first crosses said horizon boundary line and providing a slope signal based on the slope of said horizon boundary line and further providing a shading signal representing one of said sky or ground shadings wherein the improvement comprises, first digital timing means for providing a first digital signal synchronous with said raster lines;

second digital timing means for providing a second digital signal synchronous with said pixels;

transition point computing means responsive to said slope signal for providing in real time a current transition point signal representing the intersection of said horizon boundary line with said raster line being currently generated;

first comparator means responsive to said current transition point signal and to said second digital signal for providing a left-right signal indicating whether said pixel being currently generated is to the left or to the right of said horizon boundary line;

second comparator means responsive to said first digital signal and to said initial crossover word for providing an above-below signal indicating whether said raster line being currently generated is above or below said horizon boundary line;

logic means responsive to said left-right signal, said above-below signal, said slope signal, and said shading signal for providing a shading control signal representing either of said sky and ground shadings when said raster line prior to said current transition point is being generated and the other of said shadings when said raster line subsequent to said current transition point is being generated.

2. The apparatus of claim 1 wherein said first digital timing means comprises counter means for counting in synchronism with said raster lines.

3. The apparatus of claim 1 wherein said second digital timing means comprises counter means for counting in synchronism with said pixels.

4. The apparatus of claim 1 wherein said transition point computing means comprises adder means and accumulator means coupled to said adder means.

5. The apparatus according to claim 1 wherein said initial crossover word comprises an X coordinate corresponding to one of said pixels and said transition point computing means is responsive to said X coordinate.

6. The apparatus according to claim 1 wherein said initial crossover word comprises a Y coordinate corresponding to one of said raster lines, and said apparatus further comprises line delay latch means for latching said Y coordinate.

7. The apparatus according to claim 5 further comprising means for latching said X coordinate.

8. The apparatus according to claim 1 further comprising means for latching said slope signal.

9. The apparatus of claim 1 further comprising means for latching said shading signal.

10. The apparatus according to claim 1 wherein said slope signal is proportional to the negative reciprocal of the slope of said horizon boundary line.

11. The apparatus according to claim 1 wherein said logic means further comprises means for determining whether said intersection of said horizon boundary line with said raster line currently being generated is off said display face.

12. The apparatus of claim 11 wherein said transition point computing means provides an overflow signal and said means for determining whether the intersection of said horizon boundary line with said raster line currently being generated is off said display face, is responsive to said overflow signal.

* * * * *